US010921743B2

(12) United States Patent
Inoue et al.

(10) Patent No.: US 10,921,743 B2
(45) Date of Patent: Feb. 16, 2021

(54) INFORMATION PROCESSING APPARATUS THAT ENABLES COMMUNICATION WITH IMAGE FORMING APPARATUS TO WHICH FIXING DEVICES OF DIFFERENT TYPES ARE SELECTIVELY ATTACHABLE, IMAGE FORMING APPARATUS, AND CONTROL METHOD THEREFOR

(71) Applicant: CANON KABUSHIKI KAISHA, Tokyo (JP)

(72) Inventors: Seita Inoue, Kashiwa (JP); Takuya Hayakawa, Koshigaya (JP); Kiyoharu Kakomura, Nagareyama (JP); Naoka Omura, Matsudo (JP); Yuya Ohta, Abiko (JP); Shunsuke Nishimura, Tokyo (JP); Yuichi Yamamoto, Nagareyama (JP); Satoru Kojima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/874,965

(22) Filed: May 15, 2020

(65) Prior Publication Data

US 2020/0371464 A1 Nov. 26, 2020

(30) Foreign Application Priority Data

May 22, 2019 (JP) ..... JP2019-096095

(51) Int. Cl.
*G03G 15/00* (2006.01)
*G03G 21/16* (2006.01)

(52) U.S. Cl.
CPC ..... *G03G 15/556* (2013.01); *G03G 21/1685* (2013.01); *G03G 2215/0888* (2013.01)

(58) Field of Classification Search
CPC .. G03G 15/55; G03G 15/556; G03G 21/1685; G03G 21/1892; G03G 2215/734; G03G 2215/738
(Continued)

(56) References Cited

U.S. PATENT DOCUMENTS 8,582,988 B2 * 11/2013 Rapkin ..... G03G 15/5079 399/24
9,772,591 B2 * 9/2017 Taniguchi ..... G03G 15/5016
(Continued)

FOREIGN PATENT DOCUMENTS

JP 2002-132102 5/2002

OTHER PUBLICATIONS

U.S. Appl. No. 16/847,303, filed Apr. 13, 2020.
U.S. Appl. No. 16/847,291, filed Apr. 13, 2020.

*Primary Examiner* — Hoan H Tran
(74) *Attorney, Agent, or Firm* — Venable LLP

(57) ABSTRACT

An information processing apparatus that is capable of improving estimating accuracy of a usable period of a fixing device. The information processing apparatus enables communication with an image forming apparatus to which one of fixing devices is selectively attachable. A controller obtains information about a type of a fixing device attached, determines a remaining period of a second fixing device based on second data about a consumption amount of the second fixing device in a case where a first fixing device of a first type is replaced with the second fixing device of a second type, and determines a remaining period of a third fixing device based on first data about a consumption amount of the first fixing device and third data about a consumption amount of the third fixing device in a case where the first fixing device is replaced with the third fixing device of the first type.

5 Claims, 17 Drawing Sheets

(58) Field of Classification Search
USPC ..... 399/9, 12, 24, 31, 33
See application file for complete search history.

(56) References Cited

U.S. PATENT DOCUMENTS

| | | | | |
|---|---|---|---|---|
| 2012/0076515 | A1* | 3/2012 | Rapkin | G03G 15/556 399/24 |
| 2012/0076518 | A1* | 3/2012 | Rapkin | G03G 15/5079 399/24 |
| 2016/0216670 | A1 | 7/2016 | Eda et al. | G03G 15/55 |
| 2020/0201230 | A1 | 6/2020 | Ohta et al. | G03G 15/556 |

* cited by examiner

*FIG. 11*

| Device Number ID (Fixing Device) | Device Distinction Number N (Distinction of Fixing Device) | Passed-Sheet-Number History H |
|---|---|---|
| 1001 | 1 | H_A |
| 1002 | 2 | H_B |
| 1003 | 1 | H_C |

*FIG. 14*

| Address | Data |
|---|---|
| 0000 | Accumulated Passed Sheet Number |
| 0002 | Device Number |
| 0004 | Device Distinction Number |

INFORMATION PROCESSING APPARATUS THAT ENABLES COMMUNICATION WITH IMAGE FORMING APPARATUS TO WHICH FIXING DEVICES OF DIFFERENT TYPES ARE SELECTIVELY ATTACHABLE, IMAGE FORMING APPARATUS, AND CONTROL METHOD THEREFOR

BACKGROUND OF THE INVENTION

Field of the Invention

The present invention relates to an information processing apparatus that enables communication with an image forming apparatus to which fixing devices of different types are selectively attachable, the image forming apparatus, and a control method for the image forming apparatus.

Description of the Related Art

In a POD (print on demand) commercial scene where mass printing is performed using an image forming apparatus, there is the characteristic feature that the number of times of maintenance of consumables is large because of a high use frequency of the apparatus. Accordingly, about maintenance works of some consumables, a practice to send a replacement consumable to a user's place in advance and to open a replacement procedure to a user is spreading in order to facilitate maintenance by an operator of the user's place. In such a practice, it is important to notify a user of correct replacement time of a consumable in order to prevent replacement of a consumable prior to end of life or in order to prepare a consumable at a suitable timing. Japanese Laid-Open Patent Publication (Kokai) No. 2002-132102 (JP 2002-132102A) suggests a technique that estimates replacement time by calculating an average use frequency per day from a use status of an image forming apparatus within a specific period and that notifies a user of the estimated replacement time in order to give the user the correct replacement time of a consumable.

However, when consumables of different types are used selectively, the technique of the above-mentioned publication has the following problem. For example, there is a case of using a consumable that is specially adjusted when a large number of thick media like envelopes are printed. Specifically, a fixing device as a consumable that is detachably attached to an image forming apparatus may be replaced with a fixing device of a different type according to a purpose. For example, the type of a regular fixing device is different from the type of an envelope-dedicated fixing device (a fixing device for exclusive use of an envelope). The envelope-dedicated fixing device is specially adjusted in pressure force in accordance with a thickness of an envelope that is thickened by folding edges. An operator is performing a practice to replace the regular fixing device with the envelope-dedicated fixing device only when an envelope passes.

When the conventional technique is applied in such a practice, the operations of both of the envelope-dedicated fixing device and regular fixing device are not distinguished and are calculated as the use frequency in a case where the sheet supply of an envelope is exchanged with the sheet supply of another sheet within the specific period for calculating the use frequency. Since the number of printouts in using the envelope-dedicated fixing device may be greatly different from the number of printouts in using the regular fixing device, the calculated use frequency may be shifted from the use frequencies of both of the envelope-dedicated fixing device and regular fixing device. Moreover, if a period for correcting a use status is restarted whenever fixing devices are exchanged, the period for correcting a use status shortens even when the current fixing device is replaced with the former fixing device. Accordingly, since estimating accuracy of the remaining usable period of a consumable becomes low, there is a problem that correct replacement time may not be shown.

SUMMARY OF THE INVENTION

The present invention provides an information processing apparatus, an image forming apparatus, and a control method for the image forming apparatus, which are capable of improving estimating accuracy of a usable period of a fixing device attached even in a use status where fixing devices of different types are selectively employed.

Accordingly, a first aspect of the present invention provides an information processing apparatus that enables communication with an image forming apparatus to which one of fixing devices of different types is selectively attachable, the information processing apparatus including a memory configured to store data related to consumption amounts of the fixing devices, and a controller configured to obtain information related to a type of a fixing device that is attached to an image forming apparatus, determine, in a case where a first fixing device of a first type is replaced with a second fixing device of a second type that is different from the first type, a remaining period until a replacement time of the second fixing device based on second data related to a consumption amount of the second fixing device, and determine, in a case where the first fixing device is replaced with a third fixing device of the first type, a remaining period until a replacement time of the third fixing device based on first data related to a consumption amount of the first fixing device and third data related to a consumption amount of the third fixing device.

Accordingly, a second aspect of the present invention provides an image forming apparatus to which one of fixing devices of different types is selectively attachable, the image forming apparatus including a memory configured to store data related to consumption amounts of the fixing devices, and a controller configured to obtain information related to a type of a fixing device that is attached to an image forming apparatus, determine, in a case where a first fixing device of a first type is replaced with a second fixing device of a second type that is different from the first type, a remaining period until a replacement time of the second fixing device based on second data related to a consumption amount of the second fixing device, and determine, in a case where the first fixing device is replaced with a third fixing device of the first type, a remaining period until a replacement time of the third fixing device based on first data related to a consumption amount of the first fixing device and third data related to a consumption amount of the third fixing device.

Accordingly, a third aspect of the present invention provides a control method for an image forming apparatus to which one of fixing devices of different types is selectively attachable and that has a memory storing data related to consumption amounts of fixing devices of different types, the control method including obtaining information related to a type of a fixing device that is attached to an image forming apparatus, determining, in a case where a first fixing device of a first type is replaced with a second fixing device of a second type that is different from the first type, a remaining period until a replacement time of the second fixing device based on second data related to a consumption amount of the second fixing device, and determining, in a case where the first fixing device is replaced with a third fixing device of the first type, a remaining period until a replacement time of the third fixing device based on first data related to a consumption amount of the first fixing device and third data related to a consumption amount of the third fixing device.

According to the present invention, the estimating accuracy of the usable period of the fixing device attached is improved even in the use status where fixing devices of different types are selectively employed.

Further features of the present invention will become apparent from the following description of exemplary embodiments with reference to the attached drawings.

BRIEF DESCRIPTION OF THE DRAWINGS

FIG. 11 is a schematic view showing registration information about registered fixing devices.

FIG. 14 is a view showing an example of device information in an image forming apparatus according to a second embodiment of the present invention.

DESCRIPTION OF THE EMBODIMENTS

Figure 1:
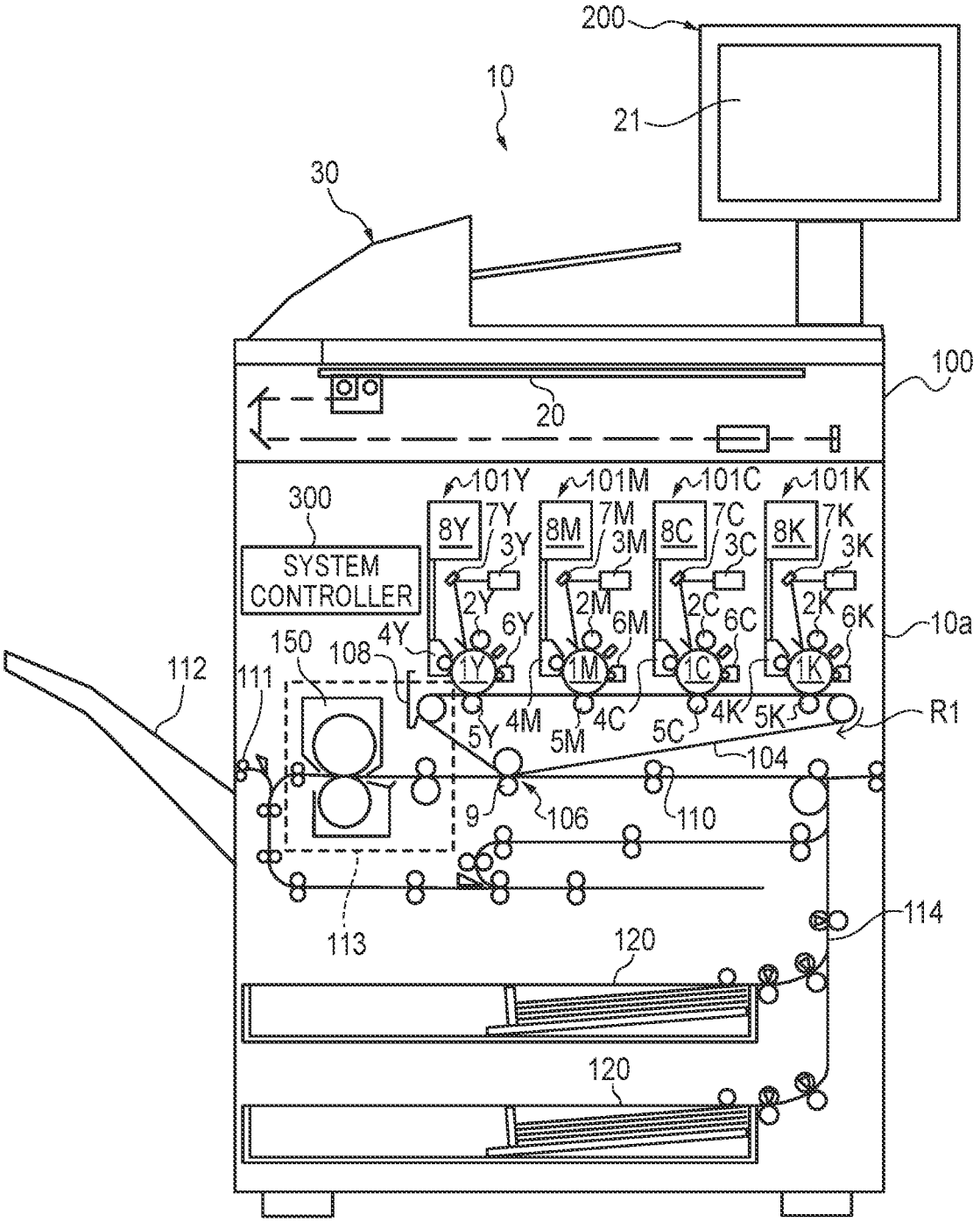
FIG. 1 is a sectional view showing an image forming apparatus according to a first embodiment of the present invention.

Hereafter, embodiments according to the present invention will be described in detail by referring to the drawings.

FIG. 1 is a sectional view showing an image forming apparatus 10 according to a first embodiment of the present invention. The image forming apparatus 10 has four image forming units 101Y, 101M, 101C, and 101K that respectively form images of four colors of yellow (Y), magenta (M), cyan (C), and black (K). The image forming unit 101Y forms a yellow image using yellow toner. The image forming unit 101M forms a magenta image using a magenta toner. The image forming unit 101C forms a cyan image using cyan toner. The image forming unit 101K forms a black image using black toner. The four image forming units have the same configuration except for a color of developer (toner). Accordingly, the image forming unit 101Y will be described as a representative in the following description.

The image forming apparatus 10 forms an image on a recording medium using an electrophotography image forming process. A recording medium (hereinafter referred to as a sheet) is a recording material on which an image is formed, such as a paper sheet (transfer paper), an OHP sheet, and a cloth sheet. The image forming apparatus 10 is an electrophotographic copying machine (for example, a digital copier), an electrophotographic printer (for example, a color laser beam printer, a color LED printer, etc.), an MFP (a multifunction apparatus), a facsimile machine, or a printing machine, for example. It should be noted that image forming apparatus 10 is not limited to an image forming apparatus that forms a color image and may be an image forming apparatus that forms a monochrome image.

The image forming units 101Y, 101M, 101C, and 101K have photosensitive drums 1Y, 1M, 1C, and 1K that are photosensitive members. The four photosensitive drums 1Y, 1M, 1C, and 1K are aligned at predetermined intervals. Charging devices 2Y, 2M, 2C, and 2K, and exposure devices 3Y, 3M, 3C, and 3K are provided around the respective photosensitive drums. Furthermore, development devices 4Y, 4M, 4C, and 4K, primary transfer rollers 5Y, 5M, 5C, and 5K, and cleaning devices 6Y, 6M, 6C, and 6K are provided around the respective photosensitive drums. Moreover, mirrors 7Y, 7M, 7C, and 7K that reflect light beams toward the photosensitive drums are provided. An endless intermediate transfer belt (hereinafter referred to as an intermediate transfer medium) 104 is arranged under the photosensitive drums. The intermediate transfer medium 104 rotates in a direction shown by an arrow R1. The intermediate transfer medium 104 contacts a secondary transfer roller 9, and forms a secondary transfer section 106 with the secondary transfer rollers 9.

Two containers (hereinafter referred to as sheet feeding cassettes) 120 that store sheets are provided in a lower part of a body 10*a* of the image forming apparatus 10. A user is able to pull out a desired sheet feeding cassette 120 from the body 10*a* of the image forming apparatus 10 and is able to store sheets in the feeding cassette 120. The feeding cassette 120 that stores the sheets is pushed into the body 10*a* of the image forming apparatus 10 by the user and is equipped.

An image reading device (a scanner unit) 100 that reads an image of a document and an automatic document feeder 30 that conveys a document to the image reading device 100 are provided in an upper portion of the image forming apparatus 10. The image reading device 100 reads an image of a document fed from the automatic document feeder 30 or a document put on a platen 20, and generates an image signal. The image forming apparatus 10 generates an image signal on the basis of a print job instructed from an operation-display unit 200 having a display unit 21 or from an external apparatus, such as a personal computer (hereinafter referred to as a PC, not shown). The generated image signal is inputted into the exposure devices 3Y, 3M, 3C, and 3K.

A door 113 as an opening-closing member that is opened and closed in order to pull out the fixing device 150 is provided in the body 10*a* of the image forming apparatus 10. The door 113 is provided in a front side of the body 10*a* near the fixing device 150 so as to open and close. The user is able to open the fixing device 150 by opening the door 113. When a paper jam occurs, the user opens the door 113 and performs a jam process to remove a jammed sheet while viewing a vicinity of the fixing device 150. Moreover, when replacing the fixing device 150, the user is able to detach the fixing device 150 by opening the door 113 and pulling out the fixing device 150.

Hereinafter, an image forming operation of the image forming apparatus 10 will be described while mainly focusing on the image forming unit 101Y. The charging device 2Y uniformly charges the surface of the photosensitive drum 1Y. The exposure device 3Y emits a laser beam (hereinafter referred to as a light beam) modulated on the basis of the image signal. A rotation polygon mirror of the exposure device 3Y deflects the light beam so as to scan the surface of the uniformly charged photosensitive drum 1Y. The deflected light beam is reflected by the mirror 7Y and irradiates the photosensitive drum 1Y. Accordingly, an electrostatic latent image is formed on the photosensitive drum 1Y. The development device 4Y develops the electrostatic latent image on the surface of the photosensitive drum 1Y with the toner and forms a toner image.

The image forming units 101M, 101C, and 101K form toner images of the respective colors on the surfaces of the respective photosensitive drums by the same operation as the image forming unit 101Y. The toner images of four colors formed on the four photosensitive drums are transferred to the intermediate transfer medium 104 by the corresponding primary transfer rollers 5Y, 5M, 5C, and 5K at predetermined timings so as to overlap. Accordingly, a color toner image is formed on the intermediate transfer medium 104.

In the meantime, the sheet fed from the sheet feeding cassette 120 is conveyed to a registration roller pair 110 through a conveyance path 114. The skew of the sheet is corrected when the front end of the sheet abuts to the stopped registration roller pair 110. The registration roller pair 110 conveys the sheet to the secondary transfer section 106 so that the front end of the toner image on the intermediate transfer medium 104 matches to the front end of the sheet at the secondary transfer section 106. The toner image on the intermediate transfer medium 104 is transferred to the sheet at the secondary transfer section 106. The residual toner on the intermediate transfer medium 104 after the toner image on the intermediate transfer medium 104 was transferred in the secondary transfer section 106 to the sheet is removed by a cleaning unit 108. The sheet to which the toner image has been transferred is conveyed to the fixing device 150. The fixing device 150 is a heat fixing unit that heats and pressurizes the toner image on the sheet to fix the toner image to the sheet. Thereby, a full color image is formed on the sheet. The sheet on which the image has been formed is discharged from a discharge part 111 to the outside of the image forming apparatus 10, and is stacked on a discharge tray 112.

Figure 2:
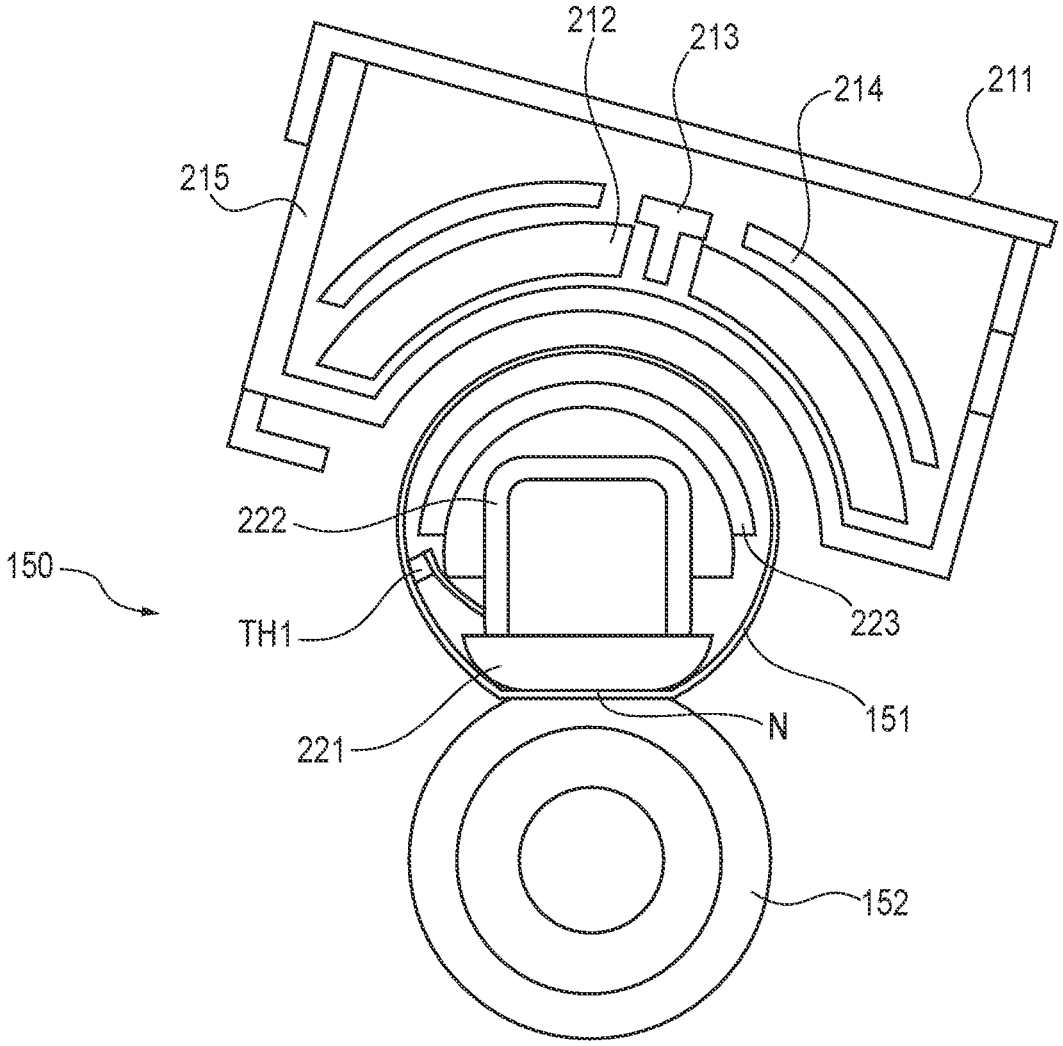
FIG. 2 is a sectional view showing a fixing device that is attached to the image forming apparatus in FIG. 1.

FIG. 2 is a sectional view showing the fixing device 150. The fixing device 150 is attachable and detachable with respect to an applied part in the body 10*a*. The fixing device 150 is a consumable that is planned to be replaced when the life comes to the end. There are a plurality of types of fixing devices that are attachable to the body 10*a* according to purposes. The user selectively attaches one of the attachable fixing devices 150. In the embodiment, a regular fixing device and an envelope-dedicated fixing device are exemplified as the fixing devices 150 of the different types. The regular fixing device 150 is used when printing using a regular sheet. The envelope-dedicated fixing device 150 is used when printing using a thick medium like an envelope, and is adjusted specially for the thick medium. Since basic constitutions of the regular and envelope-dedicated fixing devices are the same, the description in FIG. 2 does not distinguish the both devices.

As shown in FIG. 2, the fixing device 150 has an endless fixing belt 151 that has a metal layer, a pressure roller 152 that is arranged so as to contact an outer periphery of the fixing belt 151, and a pressurization member 221. The pressurization member 221 is arranged inside the fixing belt 151, and is held by a metal stay 222. The pressurization member 221 forms a fixing nip position N by applying pressing force between the fixing belt 151 and the pressure roller 152. Moreover, a magnetic shielding core 223, which prevents temperature rise owing to induction heating, is provided on the stay 222 at the side opposite to a magnetization coil 212 (mentioned later).

The fixing device 150 has an induction heating device 211 as a heating source that inductively heats the fixing belt 151. The induction heating device 211 has the magnetization coil 212 that is configured by winding a litz wire as an electric wire into a shape of an oblong ship's bottom so as to oppose a part of the circumferential surface and the side surface of the fixing belt 151. The induction heating device 211 has outside magnetic cores 213 and 214 that cover the magnetization coil 212 so as to approximately prevent leak of the magnetic field caused by the magnetization coil 212 to members other than the metal layer (conductive layer) of the fixing belt 151. Furthermore, the induction heating device 211 has a coil holding member 215 that supports the outside magnetic cores 213 and 214 with electrical insulation resin. The induction heating device 211 is arranged so as to face the fixing belt 151 at the upper side of the outer circumferential surface of the fixing belt 151. There is a predetermined gap between the induction heating device 211 and the fixing belt 151. In a rotation state of the fixing belt 151, a high frequency current of 20 kHz through 60 kHz is applied to the magnetization coil 212 of the induction heating device 211, and the magnetization coil 212 generates a magnetic field.

The metal layer of the fixing belt 151 is inductively heated by the magnetic field caused by the magnetization coil 212. A temperature sensor TH1 like a thermistor is arranged so as to contact the inner surface of the fixing belt 151 in the center position in the width direction of the fixing belt 151. The temperature sensor TH1 detects temperature in a sheet passing area of the fixing belt 151. The temperature of the fixing belt 151 is adjusted by controlling the electric power input in the magnetization coil 212 by changing the frequency of the high frequency current applied to the magnetization coil 212 on the basis of the detected temperature of the temperature sensor TH1.

In the image forming process, when a sheet is inserted into and passes the fixing nip position N, a toner image is fixed to the sheet. In that time, the fixing belt 151 is worn away because the sheet contacts the fixing belt 151. When sheets of the predetermined number pass, a fixing performance becomes insufficient because of wear of the fixing belt 151. A state where the fixing performance becomes insufficient because of wear of the fixing belt 151 is defined as the end of life of the fixing device 150. The total number of passable sheets (a life number LN) up to the end of life of the fixing device 150 is grasped experimentally beforehand. The life number LN is 60000, for example, but it is not limited to this. When sheets of the life number LN have passed through the fixing device 150, it is determined that the end of life of the fixing device 150 has come.

Moreover, a memory 230 (FIG. 3) is provided in each of the fixing devices 150. A system controller 300 provided in the image forming apparatus 10 is able to read and write data with respect to the memory 230 through communication. The memory 230 stores information about an accumulated passed sheet number Fm (the number of passed sheets) that shows the total number of sheets passing through the fixing device 150 equipped with the memory 230 concerned. Whenever a sheet passes the fixing device 150 by a print operation, the accumulated passed sheet number Fm is updated by the system controller 300 (mentions later by referring to FIG. 4). Since the fixing device 150 is consumed as the number of passed sheets increases, the accumulated passed sheet number Fm is an accumulated consumption amount from new employment of the fixing device 150

Figure 3:
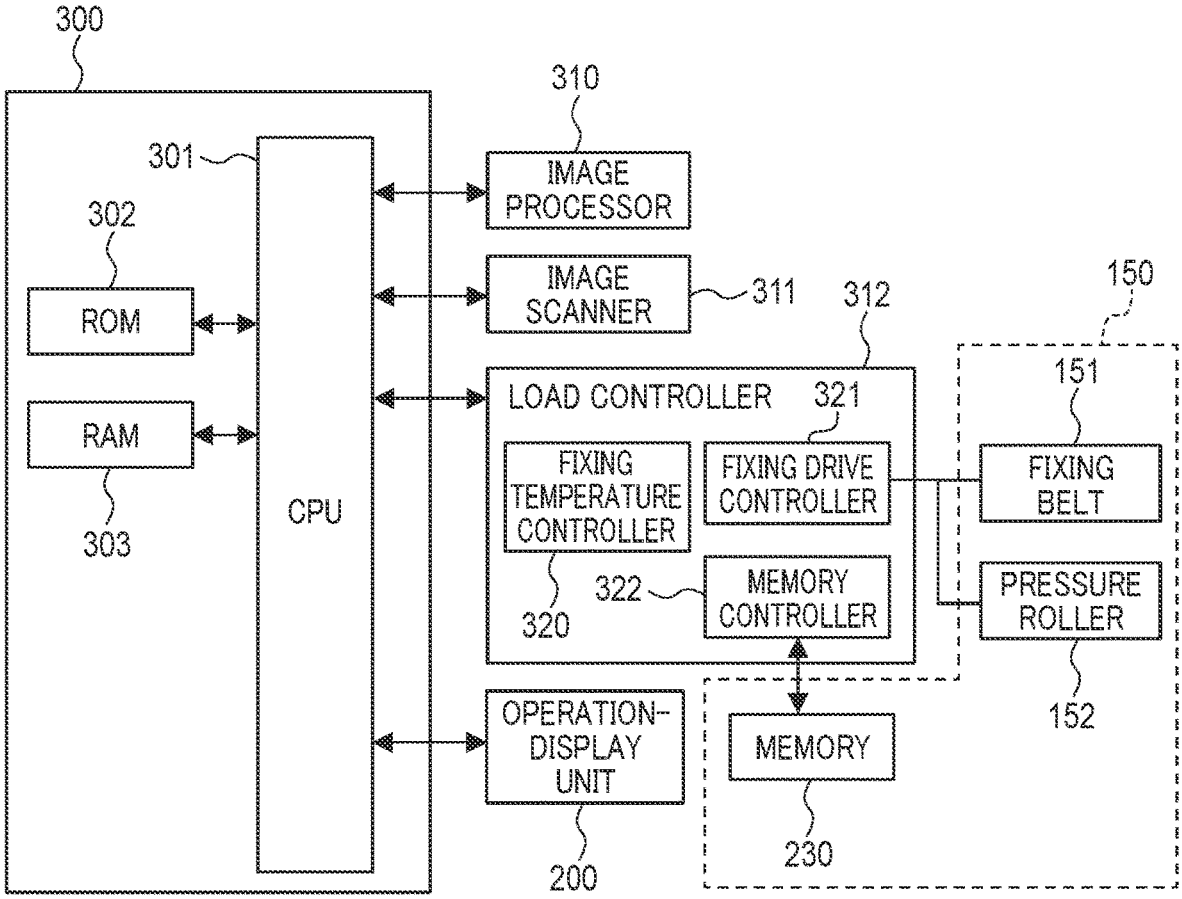
FIG. 3 is a block diagram schematically showing a functional configuration of the image forming apparatus in FIG. 1.

FIG. 3 is a block diagram schematically showing a functional configuration of the image forming apparatus 10. The image forming apparatus 10 has the system controller 300. The system controller 300 has a CPU 301, ROM 302, and RAM 303. An image processor 310, an image reader 311, and a load controller 312 besides the ROM 302 and RAM 303 are connected to the CPU 301 through a bus. Moreover, an operation-display unit 200 is connected to the CPU 301. The system controller 300 integrally controls the image forming apparatus 10. The system controller 300 drives loads in the image forming apparatus 10, collects and analyzes signals from sensors, and plays a role of data exchange with the image processor 310 and the operation-display unit 200 that is a user interface.

The CPU 301 runs programs stored in the ROM 302 to execute various sequences relevant to a predetermined image formation sequence. In that time, the CPU 301 stores rewritable data that is saved temporarily or everlastingly in the RAM 303. The RAM 303 stores image-formation instruction information from the operation-display unit 200, for example. When a print instruction is input through the operation-display unit 200 or a PC (not shown), the CPU 301 determines a print job to be executed, stores information about the print job, and displays corresponding information on the display unit 21 (FIG. 1) of the operation-display unit 200.

The load controller 312 has a fixing temperature controller 320, fixing drive controller 321, and memory controller 322. The CPU 301 integrally controls the fixing temperature controller 320, fixing drive controller 321, and memory controller 322 by sending an instruction to the load controller 312. The fixing drive controller 321 controls a formation operation of the fixing nip position N and a sheet conveyance operation by controlling the fixing belt 151 and pressure roller 152 at the time of sheet supply. The memory controller 322 controls the memory 230. The accumulated passed sheet number Fm of the fixing device 150 is saved in a designated specific address in the memory 230. The memory controller 322 controls reading and writing of the accumulated number Fm.

Next, a process to estimate a remaining usable period D2 will be described by referring to FIG. 4 through FIG. 8. The remaining usable period D2 is a usable period (days) that is estimated assuming that the fixing device 150 that is currently attached will be used at the same pace as the former.

Figure 4:
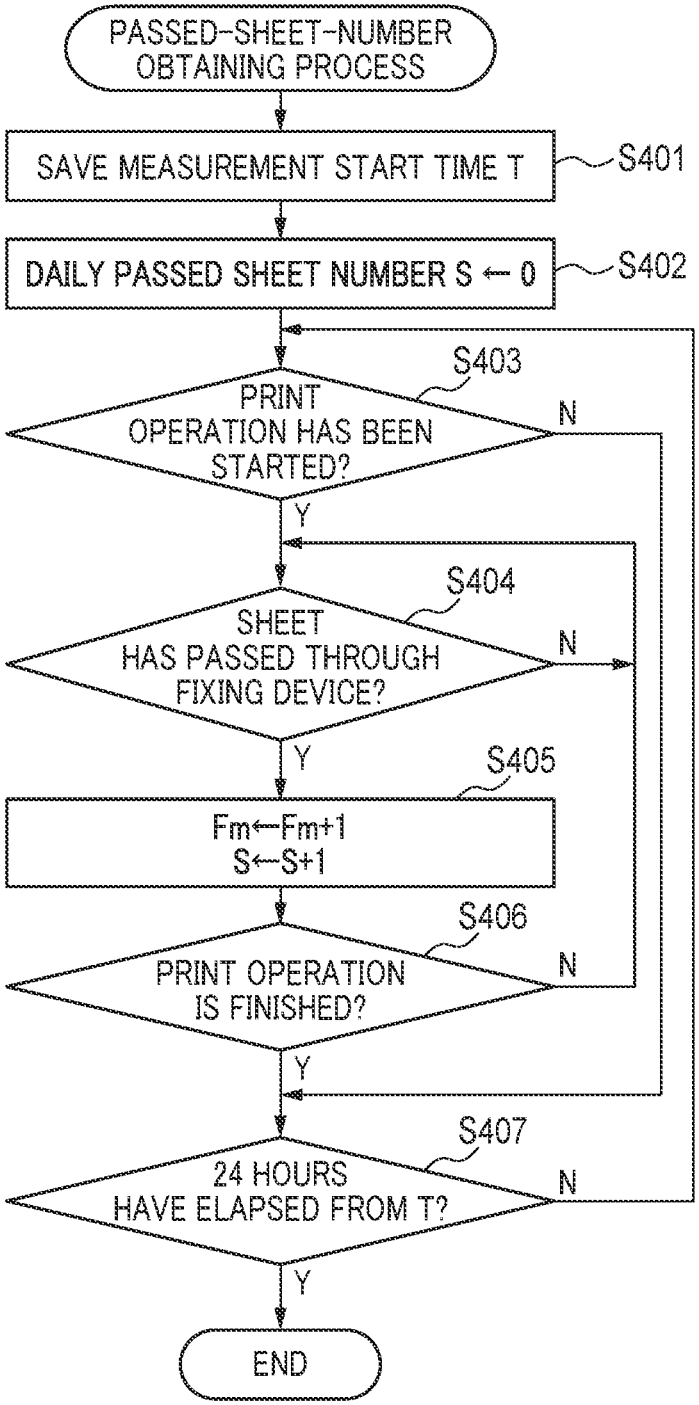
FIG. 4 is a flowchart showing a passed-sheet-number obtaining process in the first embodiment.

FIG. 4 is a flowchart showing a passed-sheet-number obtaining process. This process is achieved when the CPU 301 develops a program stored in the ROM 302 to the RAM 303 and runs it. This process starts periodically (for example, one time a day at fixed time).

First, the CPU 301 saves measurement start time T into the RAM 303 in step S401 and initializes a daily passed sheet number S (the number of passed sheets par day) to zero in step S402. The number S holds a measurement value. In step S403, the CPU 301 determines whether a print operation has been started. Then, when the print operation has not been started, the CPU 301 proceeds with the process to step S407. In the meantime, when the print operation has been started, the CPU 301 waits until a sheet passes the fixing device 150 in step S404.

Then, when the sheet has passed through the fixing device 150, the CPU 301 increments both the daily passed sheet number S and the accumulated passed sheet number Fm that are stored in the memory 230 by one in step S405. In the next step S406, the CPU 301 determines whether the print operation is finished. When the print operation is not finished, the CPU 301 returns the process to the step S404. The processes in the steps S403 through S406 update the accumulated passed sheet number Fm of the fixing device 150 to the newest value.

In the meantime, when the print operation is finished, the CPU 301 determines in step S407 whether 24 hours have elapsed from the measurement start time T. Then, when 24 hours have not elapsed from the measurement start time T, the CPU 301 returns the process to the step S403. When 24 hours (one day) have elapsed from the measurement start time T, the CPU 301 finishes the passed-sheet-number obtaining process shown in FIG. 4. Accordingly, the number of passed sheets within 24 hours from the measurement start, i.e., one day of the measurement day, is saved as the daily passed sheet number S. Moreover, the accumulated value of the number of passed sheets to the measurement day is saved as the accumulated number Fm of passed sheets. Accordingly, the accumulated passed sheet number Fm that is the consumption amount stored in the memory 230 is updated according to passage of sheets through the fixing device 150 (progress of consumption). Moreover, a passed-sheet-number history (mentioned later by referring to FIG. 5) that is a history of the daily passed sheet number S generated by the passed-sheet-number obtaining process shown in FIG. 4 is saved into the RAM 303.

The reason why the elapsed time for determination in the step S407 is 24 hours is because the unit time period is one day. Moreover, the execution interval of the passed-sheet-number obtaining process shown in FIG. 4 is matched to the unit time period. However, the unit time period is not limited to 24 hours.

Figure 5:
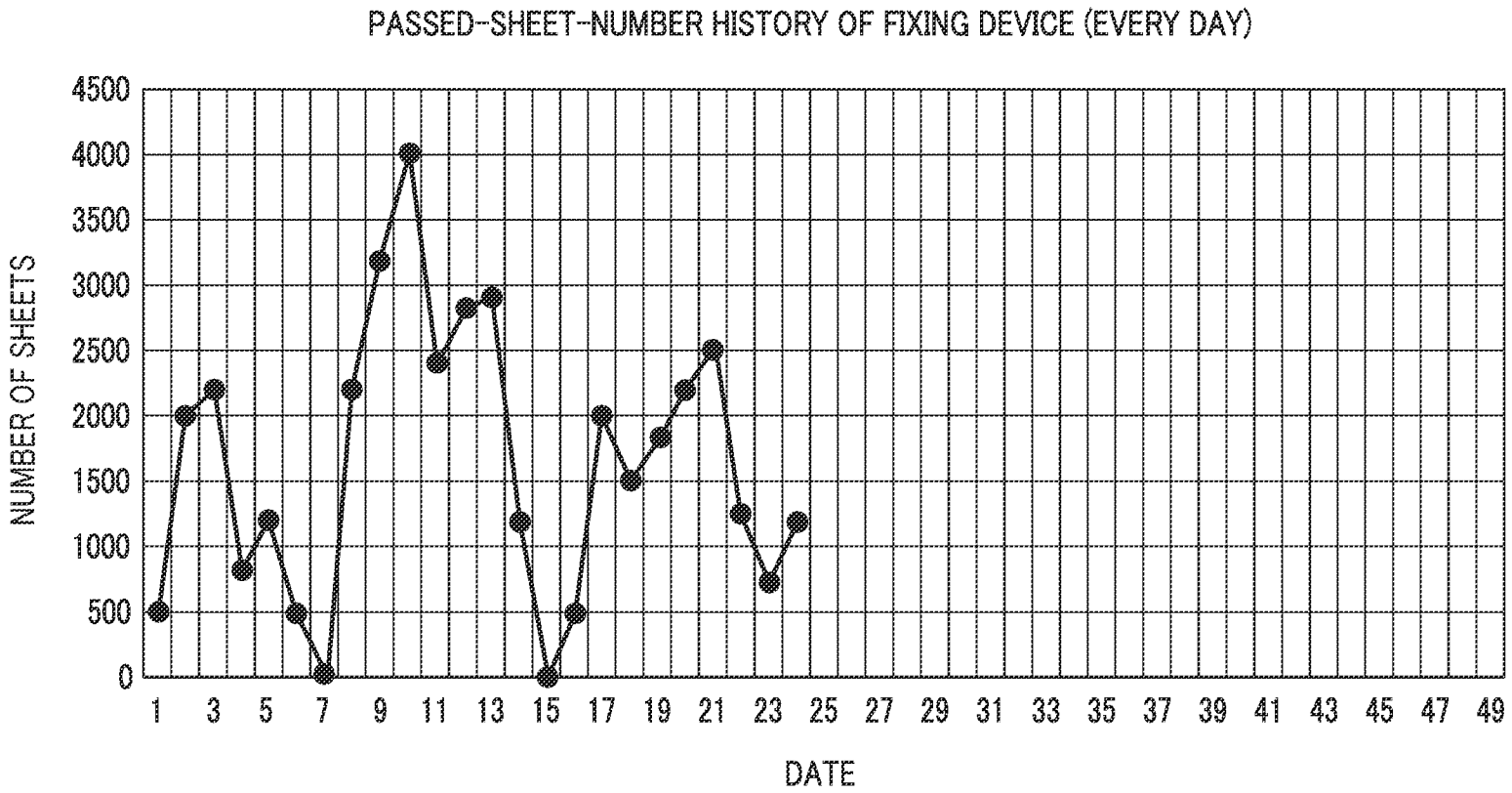
FIG. 5 is a view showing an example of a passed-sheet-number history.

FIG. 5 is a view showing an example of a passed-sheet-number history. When a consumable is a fixing device 150, the daily passed sheet numbers S are saved as the passed-sheet-number history. The example in FIG. 5 shows the history of the daily passed sheet numbers S over past 24 days from the first day on which the fixing device 150 has been attached.

Figure 6:
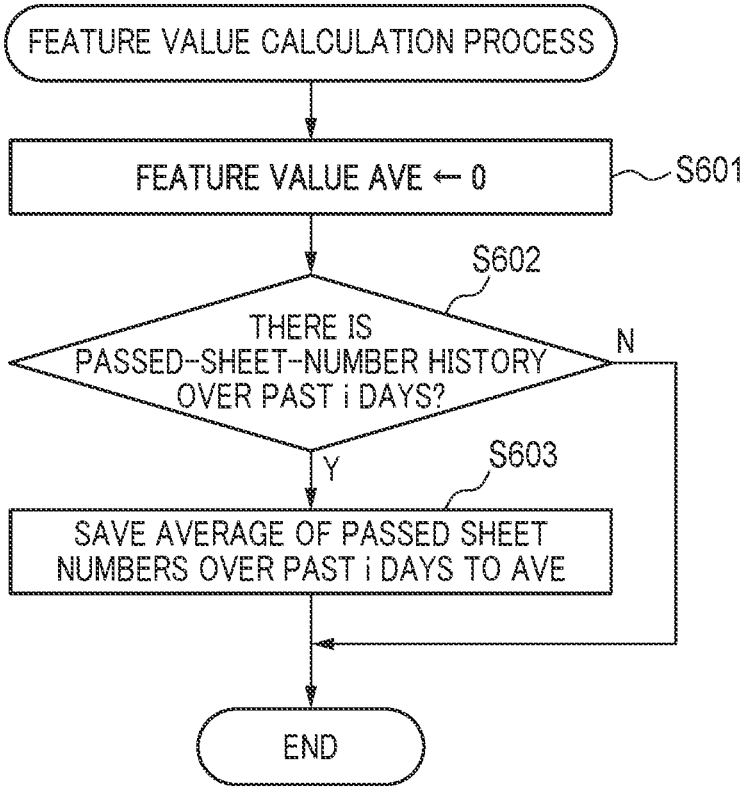
FIG. 6 is a flowchart showing a feature amount calculation process in the first embodiment.

FIG. 6 is a flowchart showing a feature amount calculation process. This process is executed in step S701 in FIG. 7 mentioned later. A feature amount AVE is a parameter that shows a feature of usage of the fixing device 150, and is calculated on the basis of the passed-sheet-number history over the predetermined period i (i is one or more days, for example, 30 days).

In step S601, the CPU 301 first initializes the feature amount AVE to zero. In the next step S602, the CPU 301 determines whether there is data of the passed-sheet-number history corresponding to the fixing device 150 attached over the past predetermined period i. It should be noted that a unit of the predetermined period i is not limited to a day. When a certain time length is a unit period, a plurality of unit periods may be the predetermined period i.

When there is the data of the passed-sheet-number history over the past predetermined period i, the CPU 301 calculates an average of the passed sheet numbers over the past i days, saves it as the feature amount AVE in step S603, and finishes the feature amount calculation process shown in FIG. 6. The feature amount AVE corresponds to the predicted number of passed sheets per one day and is used in a remaining-usable-period calculation process (FIG. 7) mentioned later. In the meantime, when there is not the data of the passed-sheet-number history over the past predetermined period i, the CPU 301 finishes the feature amount calculation process shown in FIG. 6 while keeping the feature amount as zero because the correct feature amount AVE cannot be calculated.

Figure 7:
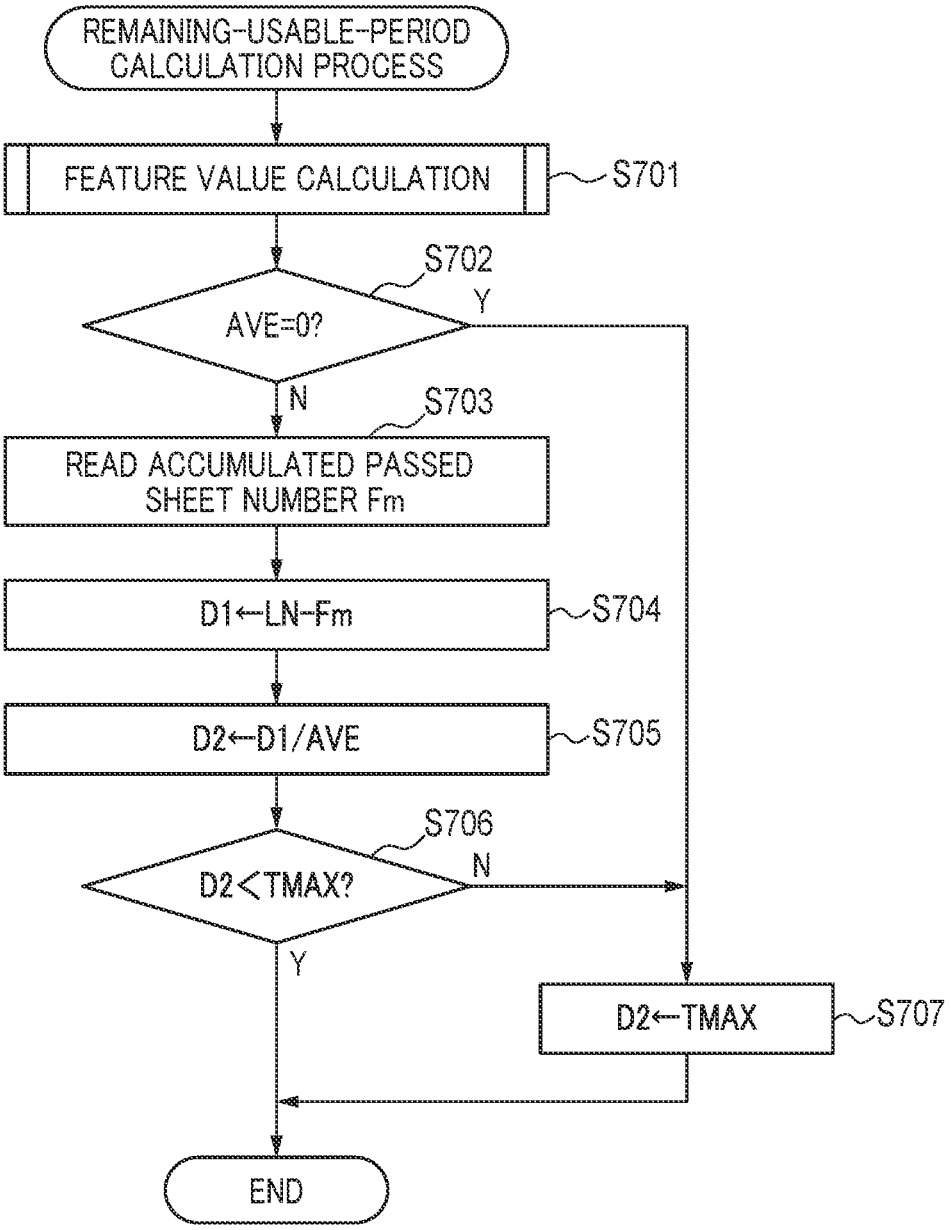
FIG. 7 is a flowchart showing a remaining-usable-period calculation process in the first embodiment.

FIG. 7 is a flowchart showing the remaining-usable-period calculation process. This process is achieved when the CPU 301 develops a program stored in the ROM 302 to the RAM 303 and runs it. This process is executed periodically (for example, one time a day at fixed time). Moreover, this process is executed also in step S1306 in FIG. 13 mentioned later. Moreover, this process may be executed corresponding to a user's instruction.

First, the CPU 301 obtains the feature amount AVE by executing the feature amount calculation process shown in FIG. 6 in the step S701, and determines whether the feature amount AVE obtained is zero in step S702. Then, since the feature amount AVE is found from the passed-sheet-number history over the predetermined period i when the feature amount AVE is not zero, the CPU 301 as an obtaining means reads an accumulated passed sheet number Fm from the memory 230 of the fixing device 150 that is currently attached in step S703. In step S704, the CPU 301 substitutes a value that is obtained by subtracting the accumulated passed sheet number Fm from the life number LN (60000) into a remaining usable sheet number D1 (D1=LN−Fm). Since the life number LN is the number of passable sheets (usable amount) until the fixing device 150 reaches the end of the life from new employment, the remaining usable sheet number D1 is the number of passable sheets until reaching the end of the life from this time.

Next the next step S705, the CPU 301 as a presuming means calculates the remaining usable period D2 by dividing the remaining usable sheet number D1 by the feature amount AVE (D2=D1/AVE). The feature amount AVE is the assumption number of passed sheets per day calculated from the passed-sheet-number history over past i days. Accordingly, the remaining usable period D2 is a remaining period within which the fixing device 150 is usable in a case of assuming that sheets of the feature amount AVE will be passed every day. In step S706, the CPU 301 determines whether the remaining usable period D2 is less than an enough period TMAX (D2<TMAX). The enough period TMAX is set to a sufficient large value (for example, 100 days) as a value notifying a user that there is a sufficient period until reaching the end of the life. It should be noted that the enough period TMAX may be the maximum value that can be displayed on the display unit 21.

When the remaining usable period D2 is less than the enough period TMAX, the CPU 301 keeps the value of the remaining usable period D2 as-is and finishes the remaining-usable-period calculation process shown in FIG. 7. In the meantime, when the remaining usable period D2 is equal to or more than the enough period TMAX, the CPU 301 proceeds with the process to step S707. In the step S707, the CPU 301 substitutes the enough period TMAX into the remaining usable period D2 and finishes the remaining-usable-period calculation process shown in FIG. 7.

Moreover, when it is determined that the feature amount AVE is zero in the step S702, the CPU 301 proceeds with the process to the step S707 because the feature amount AVE cannot be calculated owing to lack of the passed-sheet-number history over the predetermined period i, This corresponds to a case where the number of passed sheets is too small to estimate the remaining usable period D2. In this case, the enough period TMAX is set to the remaining usable period D2 in order to prevent a user from thinking that the period until the end of the life is short. In other words, the CPU 301 does not estimate the remaining usable period D2 when the passed-sheet-number history over the past predetermined period has not been obtained. This process prevents a user from replacing the fixing device 150 easily.

Figure 8:
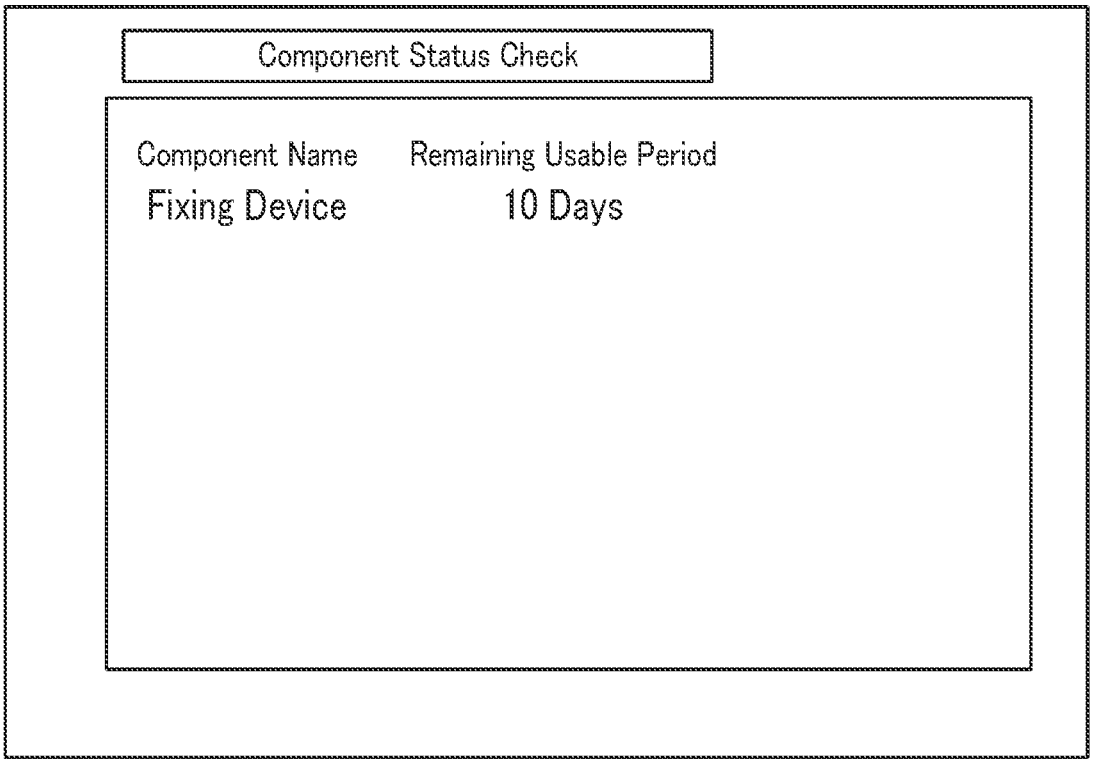
FIG. 8 is a view showing an example of a component status display screen displayed on a display unit of the image processing apparatus in FIG. 1.

FIG. 8 is a view showing an example of a component status display screen displayed on the display unit 21. This display screen is displayed when the remaining-usable-period calculation process shown in FIG. 7 is completed, for example. Moreover, this display screen may be displayed at any time in response to a user's operation. In this display screen, a character string of "Fixing Device" is displayed as a component name of a consumable, and a value of the remaining usable period D2 is displayed as days. Thereby, the remaining usable period is reported. A user who looks at this screen is able to order a new fixing device while considering the remaining usable period D2. When the enough period TMAX is set to the remaining usable period D2, "100 Days" will be displayed on the display screen shown in FIG. 8. In the meantime, a mark or a character string showing that the remaining usable period is long enough may be displayed in place of "100 Days". Since the remaining usable period D2 is not estimated in the case where the process proceeds from the step S702 to the step S707, information showing "undetermined" may be displayed as the remaining usable period on the display screen without displaying the enough period TMAX.

Figure 9:
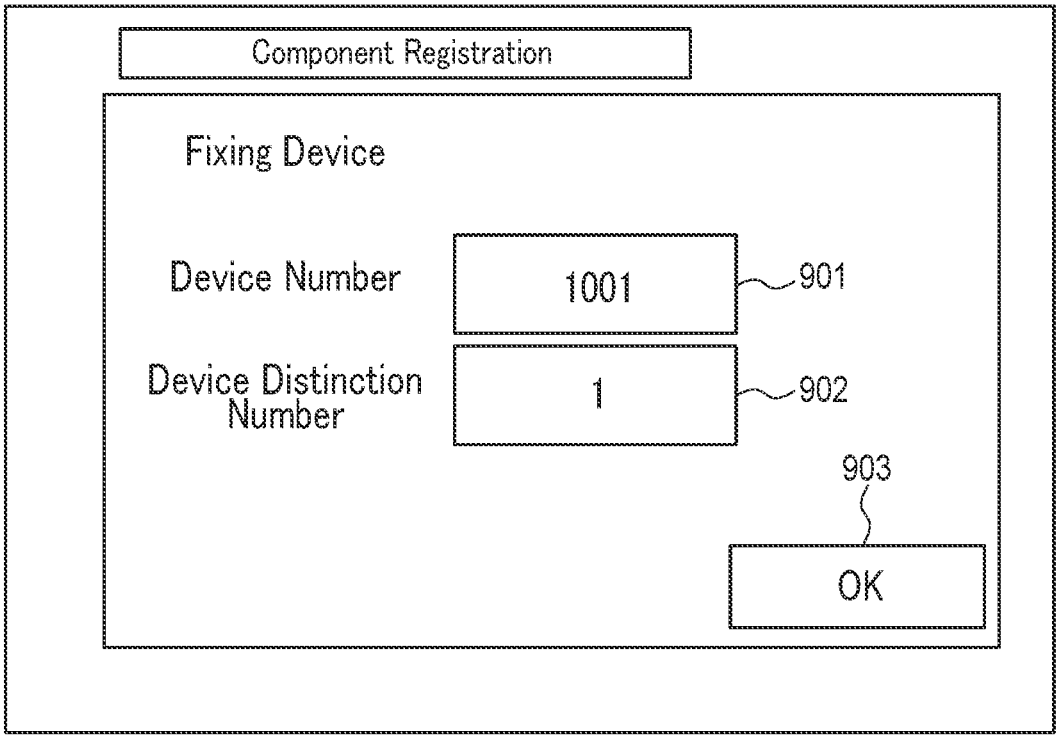
FIG. 9 is a view showing an example of a component registration screen displayed on the display unit.

Next, a component registration will be described by referring to FIG. 9, FIG. 10, and FIG. 11 in an example that a consumable is a fixing device. FIG. 9 is a view showing an example of a component registration screen displayed on the display unit 21 in order to register each of the fixing devices 150 as a replacement component to the image forming apparatus 10. In this component registration screen, "Fixing Device" is displayed as a component name of a consumable to register, and a region 901 into which a device number ID is entered and a region 902 into which a device distinction number N is entered are arranged under the component name. Moreover, an OK button 903 for entering registration completion is displayed in a lower part of the component registration screen. A user completes the registration operation by pressing the OK button 903 after entering a device number ID and device distinction number N.

FIG. 11 is a schematic view showing registration information about registered fixing devices. The CPU 301 manages the history of each fixing device by using this registration information. The device number ID (fixing device ID) is peculiar information inherent in each fixing device and specifies a fixing device uniquely. The device distinction number N (fixing device classification) shows a type of each fixing device. The same device distinction number N is assigned to fixing devices of the same usage. The passed-sheet-number history H is the information shown in FIG. 5.

It is necessary to register mutually different values to the respective fixing devices 150 that the user has about the device number ID. As shown in FIG. 11, the device numbers ID of 1001, 1002, and 1003 are registered. In the meantime, it is necessary to register the same device distinction number N to the same usage. The two fixing devices 150 (the device numbers ID are 1001 and 1003) among the three fixing devices 150 owned shall be the regular fixing devices, and the remaining one fixing device 150 (the device number ID is 1002) shall be the envelope-dedicated fixing device. In this case, as shown in FIG. 11, the device distinction numbers N of 1, 2, and 1 are respectively registered to the fixing devices 150 of which the device numbers ID are 1001, 1002, and 1003. This enables distinguishment of the device of which the device number ID is 1002 from the other two devices.

Moreover, the CPU 301 as a management means manages the passed-sheet-number histories H so as to equalize the values of the passed-sheet-number histories H of the fixing devices 150 that have the same device distinction number N (that are the same type) at a predetermined timing mentioned later. In the example shown in FIG. 11, the passed-sheet-number histories H of the fixing devices 150 of which the device numbers ID are 1001, 1002, and 1003 are H_A, H_B, and H_C, respectively. Since the fixing devices 150 of which the device numbers ID are 1001 and 1003 have the same device distinction number N, the passed-sheet-number history H_A and the passed-sheet-number history H_C are kept in the same value. That is, the CPU 301 synchronizes the passed-sheet-number histories H_A and H_C at a predetermined timing. This synchronization is achieved in step S1008 in FIG. 10 and step S1305 in FIG. 13. Details will be described later.

Figure 10:
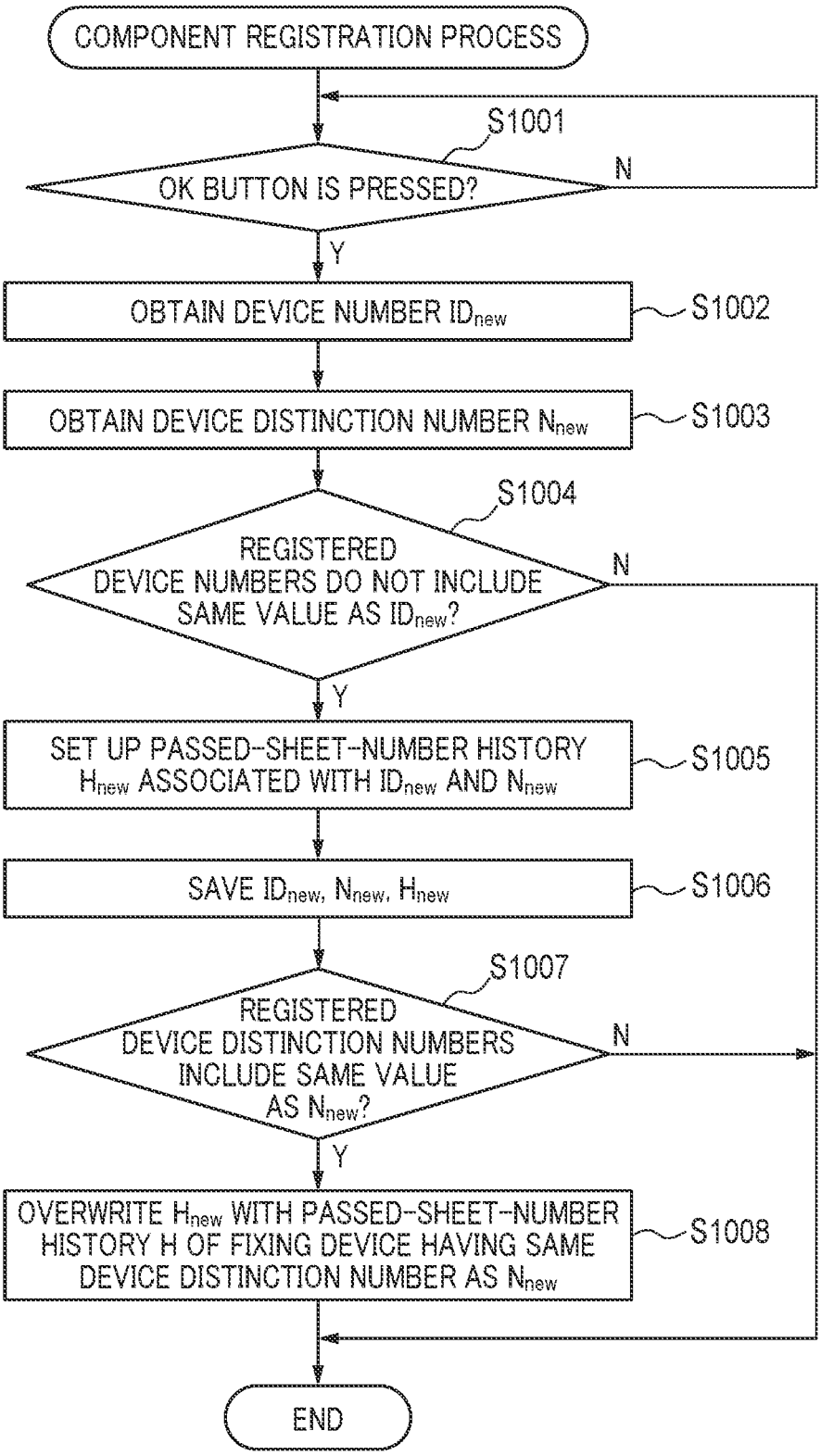
FIG. 10 is a flowchart showing a component registration process in the first embodiment.

FIG. 10 is a flowchart showing a component registration process. This process is achieved when the CPU 301 develops a program stored in the ROM 302 to the RAM 303 and runs it. This process starts when a start instruction of a component registration is input, for example. A user inputs the start instruction of the component registration through the operation-display unit 200, for example. When this process starts, the component registration screen (FIG. 9) is displayed on the display unit 21.

In step S1001, the CPU 301 waits until the OK button 903 in the component registration screen is pressed. When the OK button 903 is pressed, the CPU 301 obtains a device number $ID_{new}$ and device distinction number $N_{new}$ of the fixing device 150 that the user is going to register this time in steps S1002 and S1003. The device number $ID_{new}$ and device distinction number $N_{new}$ obtained are the values entered into the regions 901 and 902. The user recognizes the device number $ID_{new}$ and device distinction number $N_{new}$ from a label of the fixing device 150 to be registered and enters them into the regions 901 and 902.

In step S1004, the CPU 301 determines whether the registered device numbers ID do not include the same value as the device number $ID_{new}$ obtained this time. When the registered device numbers ID include the same value as the device number $ID_{new}$ obtained this time, the CPU 301 finishes the component registration process shown in FIG. 10 in order to avoid duplicate registration. In the meantime, when the registered device numbers ID do not include the same value as the device number $ID_{new}$ obtained this time, the fixing device 150 that the user is going to register this time is unregistered. Accordingly, the CPU 301 sets up a passed-sheet-number history $H_{new}$ corresponding (associated) to the device number $ID_{new}$ and device distinction number $N_{new}$ in step S1005. Then, the CPU 301 saves the device number $ID_{new}$, device distinction number $N_{new}$, and passed-sheet-number history $H_{new}$ to the RAM 303 in step S1006. According to this register operation, the CPU 301 is able to hold the device number ID and the device distinction number N and passed-sheet-number history H, which are associated with the device number ID, as the registration information for every fixing device 150.

In the next step S1007, the CPU 301 determines whether the registered device distinction numbers N include the same value as the device distinction number $N_{new}$. When the registered device distinction numbers N include the same value as the device distinction number $N_{new}$, the CPU 301 overwrites the passed-sheet-number history $H_{new}$ with the passed-sheet-number history H of the fixing device 150 having the same device distinction number N as the device distinction number $N_{new}$ in step S1008. That is, the CPU 301 sets the value of the passed-sheet-number history $H_{new}$ of the fixing device 150 that newly registers to the value of the passed-sheet-number history H of the registered fixing device 150 of the same type. Thereby, the CPU 301 synchronizes the passed-sheet-number histories H of the fixing devices 150 having the same device distinction number N at the timing of the component registration, and shares the same passed-sheet-number history H. For example, the fixing device 150 of which the device number ID is 1003 shall be newly registered in a state where the fixing devices 150 of which the device numbers ID are 1001 and 1002 have been registered in the example in FIG. 11. In this case, the passed-sheet-number history H_C ($H_{new}$) is overwritten by the passed-sheet-number history H_A. Then, the CPU 301 finishes the component registration process shown in FIG. 10.

In the meantime, when it is determined that the registered device distinction numbers N do not include the same value as the device distinction number $N_{new}$ in the step S1007, the CPU 301 keeps the passed-sheet-number history $H_{new}$ intact and finishes the component registration process shown in FIG. 10. For example, the fixing device 150 of which the device number ID is 1002 shall be newly registered in a state where the fixing devices 150 of which the device numbers ID are 1001 and 1003 have been registered in the example in FIG. 11. In this case, the passed-sheet-number history H_B ($H_{new}$) is kept as-is.

Next, an operation of component replacement in the state where the plurality of fixing devices 150 are registered as replacement components will be described by referring to FIG. 12A, FIG. 12B, FIG. 12C, and FIG. 13.

Figure 12A:
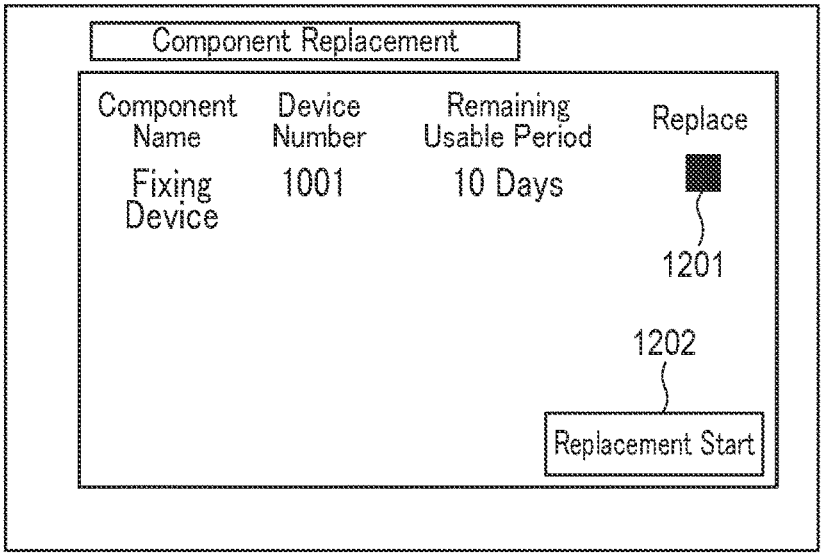
FIG. 12A, FIG. 12B, and FIG. 12C are views showing examples of component replacement screens.
Figure 12B:
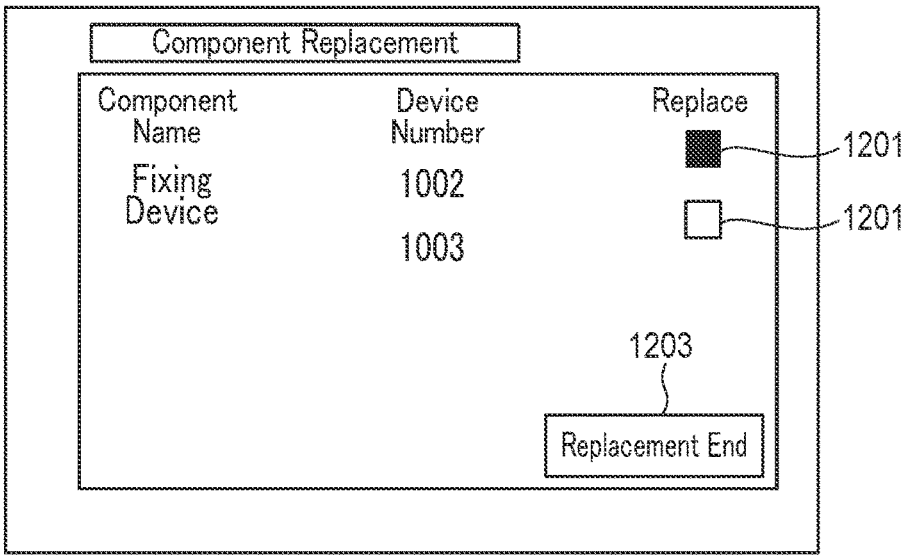
Figure 12C:
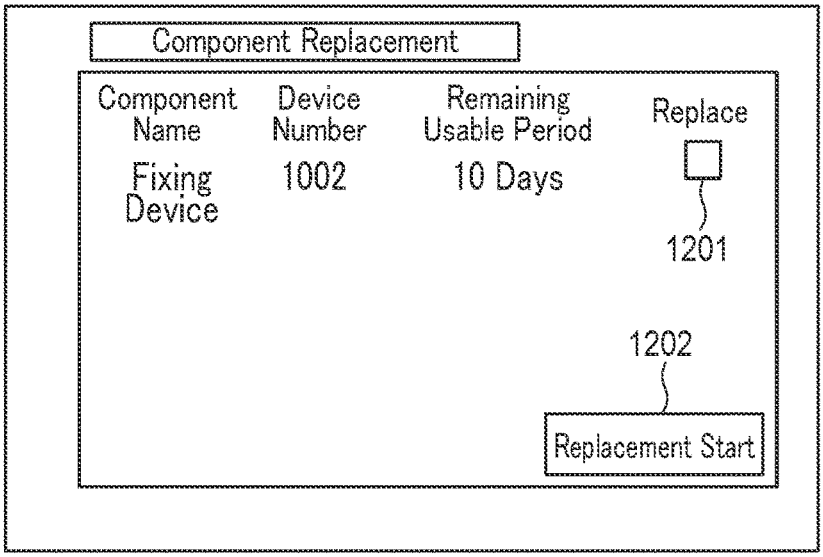

FIG. 12A, FIG. 12B, and FIG. 12C are views showing examples of component replacement screens displayed on the display unit 21. FIG. 12A, FIG. 12B, and FIG. 12C respectively show the component replacement screens before replacement, during replacement, and after replacement in a case where the fixing device 150 of which the device number ID is 1001 is replaced with the fixing device 150 (it is not always new) of which the device number ID is 1002. A component name, a device number ID of the fixing device 150 that is currently attached, and at least one check box 1201 are displayed on every component replacement screen. The remaining usable period D2 and a replacement start button 1202 are also displayed on the screens in FIG. 12A and FIG. 12C. A replacement end button 1203 is also displayed on the screen in FIG. 12B.

When the replacement process starts, the screen in FIG. 12A is displayed. When the user presses the replacement start button 1202 after checking the check box 1201 on the screen in FIG. 12A, the display is changed to the screen in FIG. 12B. About a selected component (a fixing device, in this example), the device numbers ID of unattached components among all the registered components are displayed on the screen in FIG. 12B.

The user detaches the fixing device 150 of which the device number ID is 1001 and newly attaches the fixing device 150 of which the device number ID is 1002 in the state where the screen in FIG. 12B is displayed. Furthermore, the user checks the check box 1201 of the device number 1002 of the replaced component and presses the replacement end button 1203. It should be noted that the actual replacement may be performed before or after the check of the check box 1201. As a result of this, the replacement operation is completed.

When the replacement end button is pressed, the display is changed to the screen in FIG. 12C. The device number ID (1002) and the remaining usable period D2 of the fixing device 150 after replacement are displayed on this screen.

Figure 13:
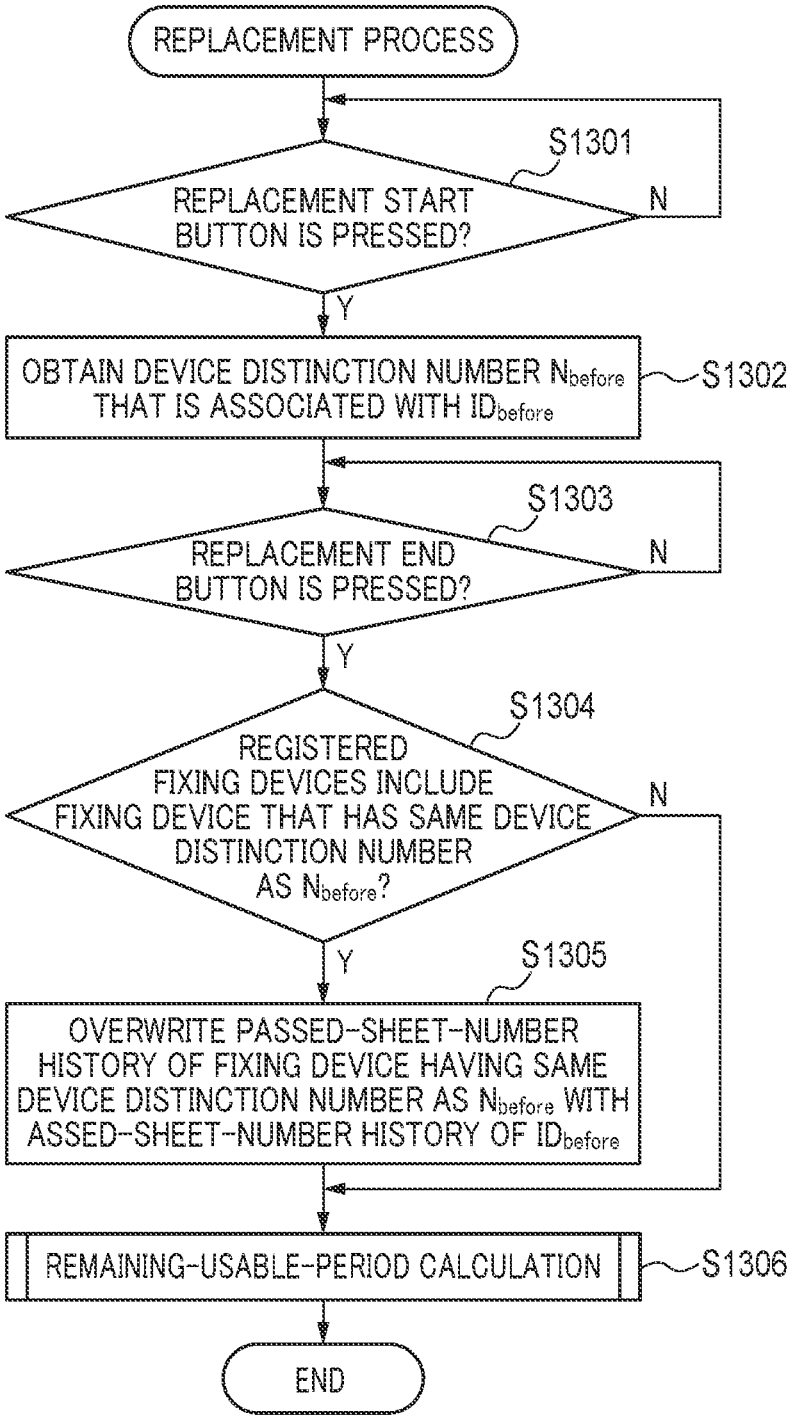
FIG. 13 is a flowchart showing a replacement process in the first embodiment.

FIG. 13 is a flowchart showing a replacement process. This process is achieved when the CPU 301 develops a program stored in the ROM 302 to the RAM 303 and runs it. This process starts when a start instruction of a component replacement is input, for example. A user inputs the start instruction of the component replacement through the operation-display unit 200, for example. When this process starts, the component replacement screen (FIG. 12A) is displayed on the display unit 21.

In the description of this process, a device number and device distinction number of the fixing device 150 (before replacement) that is currently attached shall be denoted as $ID_{before}$ and $N_{before}$. A device number of a fixing device 150 (after replacement) shall be denoted as $ID_{after}$. First, the CPU 301 waits until the replacement start button 1202 on the component replacement screen (FIG. 12A) is pressed. When the replacement start button 1202 is pressed, the CPU 301 will obtain the device distinction number $N_{before}$ corresponding to (associated with) the device number $ID_{before}$ from the registration information in step S1302. In step S1303, the CPU 301 waits until the replacement end button 1203 on the component replacement screen (FIG. 12B) is pressed.

When the replacement end button 1203 is pressed, the CPU 301 determines whether the registered fixing devices 150 include a fixing device 150 that has the same device distinction number N as the device distinction number $N_{before}$ in step S1304. When the registered fixing devices 150 include a fixing device 150 that has the same device distinction number N as the device distinction number $N_{before}$, the CPU 301 proceeds with the process to step S1305. In the step S1305, the CPU 301 overwrites (updates) the passed-sheet-number history H of the fixing device 150 that has the same device distinction number N as the device distinction number $N_{before}$ with the passed-sheet-number history H associated with the device number $ID_{before}$. That is, the CPU 301 updates the value of the passed-sheet-number history H of the registered fixing device 150 of the same type as the fixing device 150 before replacement with the value of the passed-sheet-number history H of the fixing device 150 before replacement. Accordingly, the passed-sheet-number histories H are synchronized between the fixing device 150 before replacement and the fixing device 150 that has the same device distinction number N at the timing of component replacement, and the passed-sheet-number history H is shared.

The reason of performing such a process is because the passed-sheet-number history H of the fixing device 150 before replacement is in the newest state by sheet passing until just before replacement. Thereby, the CPU 301 synchronizes the passed-sheet-number histories H of the fixing devices 150 having the same device distinction number N at the timing of the component replacement, and shares the same passed-sheet-number history H. For example, the fixing device 150 of which the device number ID is 1001 shall be replaced with the fixing device 150 of which the device number ID is 1003 in a state where the fixing devices 150 of which the device numbers ID are 1001, 1002, and 1003 have been registered in the example in FIG. 11. In this case, the passed-sheet-number history H_C is updated by the passed-sheet-number history H_A.

After step S1305, the CPU 301 proceeds with the process to step S1306. Moreover, when it is determined that the registered fixing devices 150 do not include a fixing device 150 that has the same device distinction number N as the device distinction number $N_{before}$ in the step S1304, the process proceeds to the step S1306. In the step S1306, the CPU 301 executes the remaining-usable-period calculation process shown in FIG. 7 about the fixing device 150 after replacement (the device number $ID_{after}$). In that time, the CPU 301 displays the component replacement screen shown in FIG. 12C during a certain fixed period, for example, and then, finishes the replacement process shown in FIG. 13.

According to the embodiment, the CPU 301 manages the peculiar information (device number ID), the type (device distinction number N), and the consumption history (passed-sheet-number history H) by associating them and keeps the values of the consumption histories of the fixing devices of the same type to the common value. That is, the CPU 301 synchronizes the passed-sheet-number histories H of the fixing devices 150 that have the same device distinction number N at the timing of the component registration or the component replacement. Thereby, the consumption histories (passed-sheet-number histories H) of the fixing devices of the same type are managed as common history information so as to keep the same value. The CPU 301 estimates the remaining usable period D2 of the attached fixing device 150 that is currently attached on the basis of the consumption amount (accumulated passed sheet number Fm) of the attached fixing device 150 and the common history information corresponding to the type of the attached fixing device 150. Accordingly, since the passed-sheet-number histories H of the different types are distinguished and collected, the calculation accuracy of the remaining usable period D2 increases. Moreover, since the collecting periods of the passed-sheet-number histories H of the fixing devices 150 of the same type are added together, the calculation accuracy of the remaining usable period D2 increases because a learning period becomes longer as compared with a case where the passed-sheet-number histories H are individually collected. Accordingly, the estimating accuracy of the usable period of the fixing device attached is improved even in the use status where fixing devices of different types are selectively employed.

Moreover, since the passed-sheet-number histories H are synchronized at the timing of the component registration, the value of the passed-sheet-number history H of the fixing device 150 that has been registered is succeeded to the passed-sheet-number history H of the fixing device 150 of the same type that is newly registered. Moreover, since the passed-sheet-number histories H are synchronized at the timing of the component replacement, the value of the passed-sheet-number history H of the fixing device 150 before replacement is succeeded to the passed-sheet-number history H of the registered fixing device 150 of the same type as the fixing device 150 before replacement.

Figure 15:
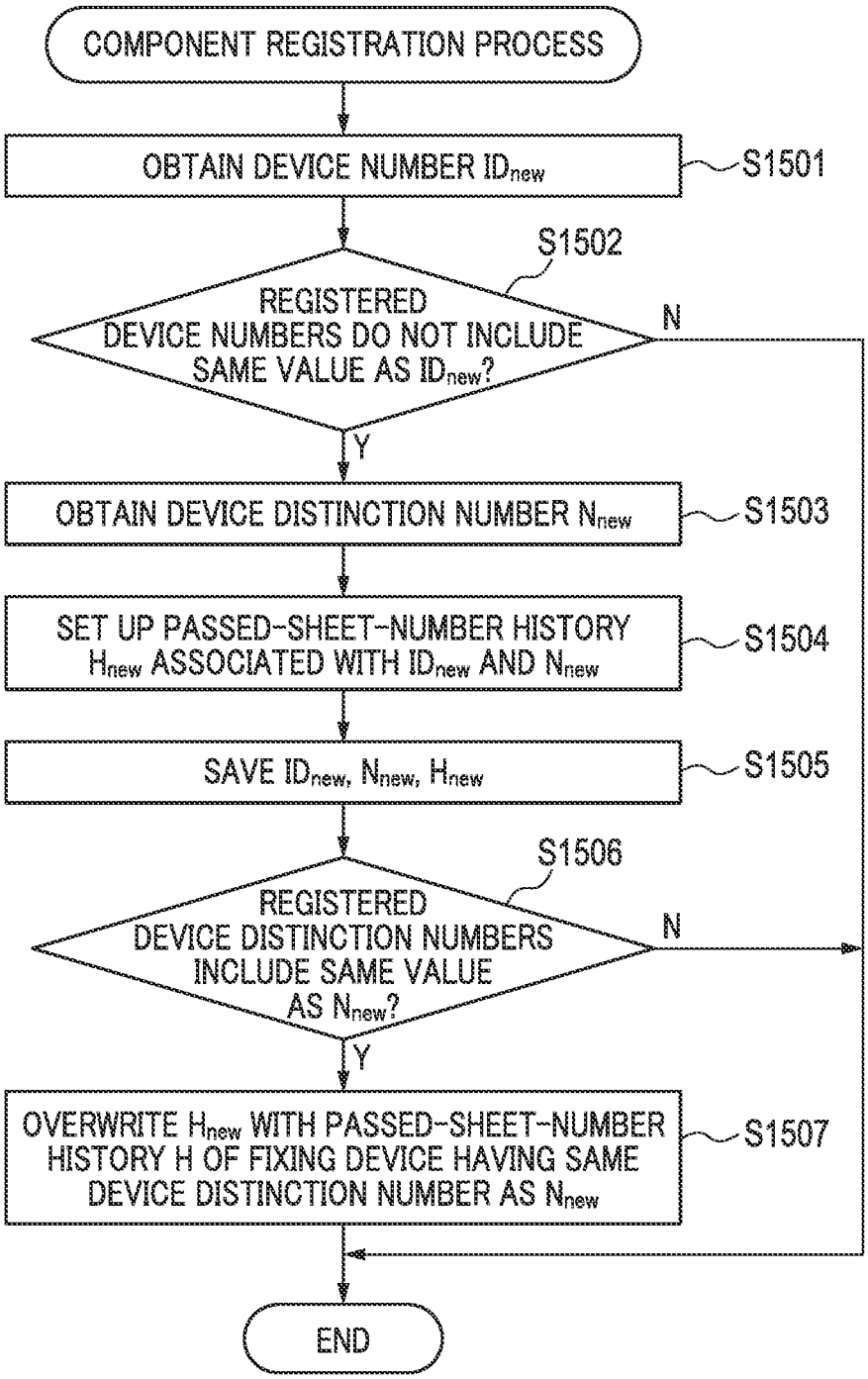
FIG. 15 is a flowchart showing a component registration process in the second embodiment.
Figure 16:
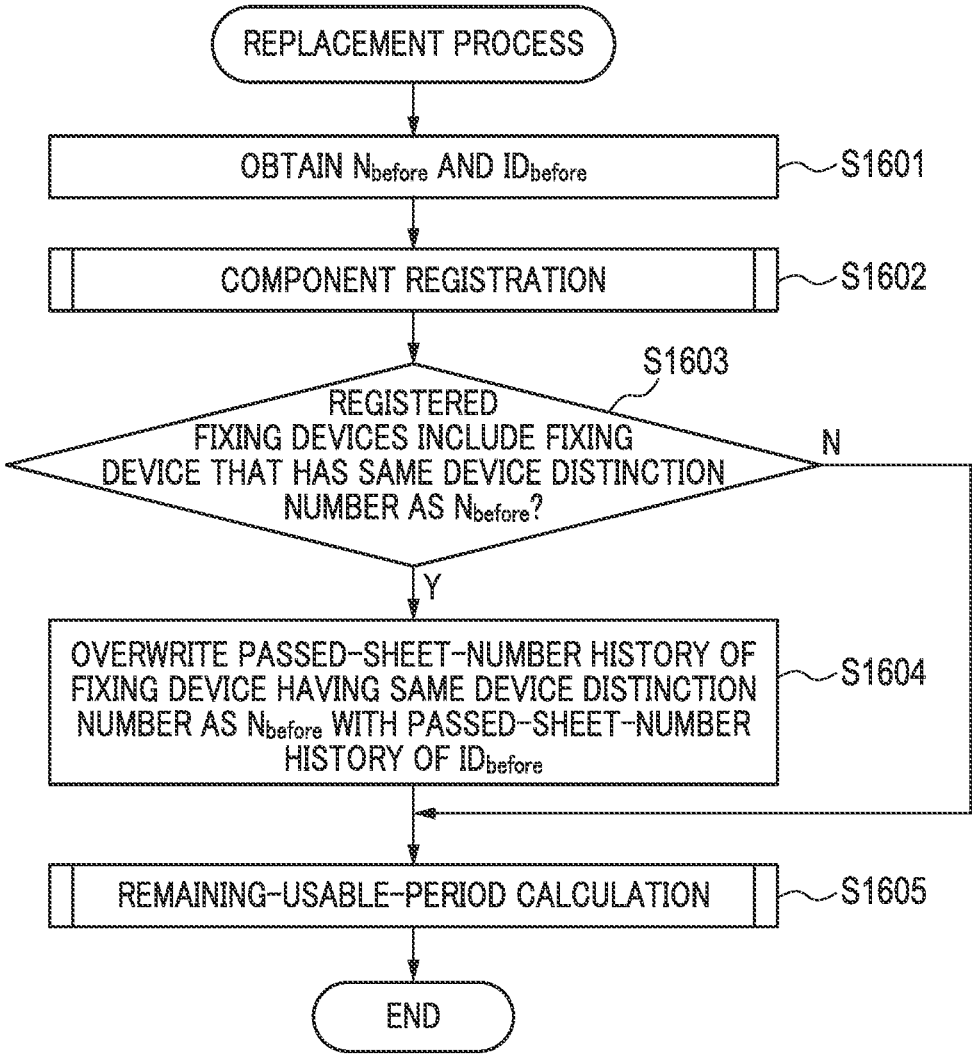
FIG. 16 is a flowchart showing a replacement process in the second embodiment.

Next, a second embodiment of the present invention will be described. In the first embodiment, the user manually registers the fixing devices 150. As compared with this, in the second embodiment of the present invention, the fixing device 150 is automatically registered when the fixing device 150 is newly attached by replacement using the memory 230. The second embodiment will be described by referring to FIG. 14, FIG. 15, and FIG. 16. In the second embodiment, the configurations that are not described are identical to that of the first embodiment. In the second embodiment, a component registration process shown in FIG. 15 is executed instead of the component registration process of the first embodiment shown in FIG. 10. Moreover, a replacement process shown in FIG. 16 is executed instead of the process shown in FIG. 13. It should be noted that the passed-sheet-number histories H are synchronized in step S1507 in FIG. 15 and step S1604 in FIG. 16.

FIG. 14 is a view showing an example of the device information stored in predetermined addresses of the memory 230. The device information includes the accumulated passed sheet number Fm, device number ID, and device distinction number N. The device number ID and device distinction number N are stored beforehand, and the accumulated passed sheet number Fm is updated by use as mentioned above. It should be noted that the device information shown in FIG. 14 may be stored in the memory 230 in the above-mentioned first embodiment.

FIG. 15 is a flowchart showing the component registration process. This process is executed in step S1602 in FIG. 16 mentioned later. FIG. 16 is a flowchart showing the replacement process. An execution subject and execution start condition of this process are the same as that of the replacement process shown in FIG. 13. However, it is not indispensable that the component replacement screen as shown in FIG. 12A is displayed. In the description of this process, a device number and device distinction number of the fixing device 150 (before replacement) that is currently attached shall be denoted as $ID_{before}$ and $N_{before}$. A device number and device distinction number of the fixing device 150 (after replacement) that will be newly attached and registered shall be denoted as $ID_{new}$ and $N_{new}$.

In step S1601, the CPU 301 first obtains the device number $ID_{before}$ and device distinction number $N_{before}$ by reading from the memory 230 of the fixing device 150 that is currently attached before replacement. After that, the user replaces the fixing device 150. When detecting that the fixing device 150 has been replaced, the CPU 301 proceeds with the process to step S1602. For example, a sensor that detects whether the fixing device 150 is attached to a mount in the body 10*b* is provided. When a sensor value of an ON state varies to an OFF state and varies to the ON state again, the CPU 301 determines that the fixing device 150 has been replaced. In the step S1602, the CPU 301 executes the component registration process (FIG. 15).

In step S1501, the CPU 301 obtains the device number $ID_{new}$ from the memory 230 of the fixing device 150 (after replacement) that is newly registered. In step S1502, the CPU 301 determines whether the registered device numbers ID do not include the same value as the device number $ID_{new}$ obtained this time. When the registered device numbers ID include the same value as the device number $ID_{new}$ obtained this time, the CPU 301 finishes the component registration process shown in FIG. 15 in order to avoid duplicate registration. In the meantime, when the registered device numbers ID include the same value as the device number $ID_{new}$ obtained this time, the CPU 301 obtains the device distinction number $N_{new}$ from the memory 230 of the fixing device 150 after replacement.

In steps S1504 through S1507, the CPU 301 performs the same process as the steps S1005 through S1008 in FIG. 10. Thereby, when the fixing device 150 after replacement is unregistered, the CPU 301 synchronizes the passed-sheet-number histories H between the fixing device 150 after replacement and the fixing device 150 of which the device distinction number N is common, and shares the passed-sheet-number history H.

After the step S1602 in FIG. 16, in steps S1603 through S1605, the CPU 301 performs the same process as the steps S1304 through S1306 in FIG. 13. Accordingly, the CPU 301 enables the component registration at the timing of the component replacement, synchronizes the passed-sheet-number histories H between the fixing device 150 before replacement and the fixing device 150 that has the same device distinction number N, and shares the passed-sheet-number history H.

The second embodiment exhibits the same effect as the first embodiment about the improvement of the estimating accuracy of the usable period of the fixing device attached even in the use status where fixing devices of different types are selectively employed. Moreover, since the component registration is automatically performed when an unregistered fixing device 150 is newly attached by replacement, complicatedness is mitigated.

Next, a third embodiment of the present invention will be described. In the first and second embodiment, the image forming apparatus 10 determines the usable period of the fixing device 150. As compared with this, in the third embodiment, an external information processing apparatus connected to the image forming apparatus 10 determines the usable period of the fixing device 150.

Figure 17:
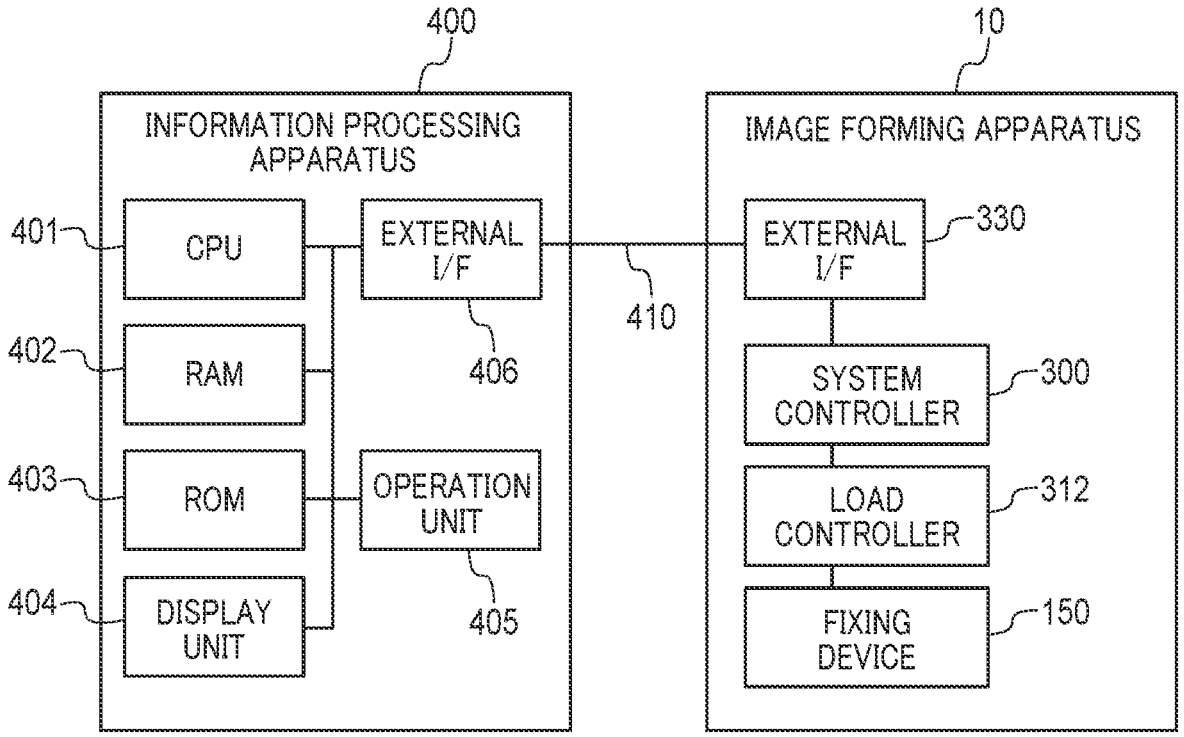
FIG. 17 is a block diagram schematically showing an image forming system according to a third embodiment of the present invention.

FIG. 17 is a block diagram schematically showing an image forming system including the information processing apparatus according to the third embodiment of the present invention. The image forming system shown in FIG. 17 consists of the image forming apparatus 10 and the information processing apparatus 400 like a PC that is connected to the image forming apparatus 10 through a network 410. The information processing apparatus 400 is provided with a CPU 401, a RAM 402, a ROM 403, a display unit 404, an operation unit 405, and an external I/F (interface) 406. The configuration of the image forming apparatus 10 is similar to that of the first embodiment and is provided with an external I/F 330, the system controller 300, the load controller 312, and the fixing device 150 as a consumable.

The system controller 300 of the image forming apparatus 10 periodically executes the passed-sheet-number obtaining process shown in FIG. 4 and saves the accumulated passed sheet number Fm and the daily passed sheet number S into the memory of the fixing device 150 through the load controller 312.

The CPU 401 of the information processing apparatus 400 executes the feature amount calculation process in FIG. 6 and the remaining-usable-period calculation process in FIG. 7 by developing a program stored in the ROM 403 to the RAM 402 and by running it. In that time, the CPU 401 requests the data of the passed-sheet-number history over the past predetermined period i from the image forming apparatus 10 through the external I/F 406 in the step S602. When receiving the request through the external I/F 330, the system controller 300 of the image forming apparatus 10 reads the data of the passed-sheet-number history that is a history of the daily passed sheet number S from the memory of the fixing device 150 through the load controller 312, and transmits it to the information processing apparatus 400 through the external I/F 330. Moreover, the information processing apparatus 400 obtains the accumulated passed sheet number Fm from the image forming apparatus 10 similarly in step S703.

Then, the CPU 401 of the information processing apparatus 400 determines the remaining usable period (remaining period) D2 on the basis of the processes in FIG. 6 and FIG. 7 and transfers this information to the image forming apparatus 10.

It should be noted that the information processing apparatus 400 executes the registration process and replacement process of the fixing device in the same manner as the first embodiment.

It should be noted that the timing of synchronizing the values to keep the values of the consumption histories of the fixing devices of the same type to the common value is not limited to the exemplified timing in each of the embodiments. The values of the registered devices may be synchronized periodically.

The passed-sheet-number histories H are saved for the respective fixing devices 150 even if a plurality of fixing devices have the same device distinction number N in the embodiments. However, a single passed-sheet-number history H may be associated with fixing devices that have the same device distinction number N and the passed-sheet-number history H may be managed as common history information.

Although the present invention has been described in detail on the basis of the suitable embodiments, the present invention is not limited to these specific embodiments and includes various configurations that do not deviate from the scope of the present invention. Parts of the above-mentioned embodiments may be combined suitably.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-096095, filed May 22, 2019, which is hereby incorporated by reference herein in its entirety.

What is claimed is:

1. An information processing apparatus that enables communication with an image forming apparatus to which one of fixing devices of different types is selectively attachable, the information processing apparatus comprising:

a memory configured to store data related to consumption amounts of the fixing devices;

a controller configured to:

obtain information related to a type of a fixing device that is attached to an image forming apparatus;

determine, in a case where a first fixing device of a first type is replaced with a second fixing device of a second type that is different from the first type, a remaining period until a replacement time of the second fixing device based on second data related to a consumption amount of the second fixing device; and determine, in a case where the first fixing device is replaced with a third fixing device of the first type, a remaining period until a replacement time of the third fixing device based on first data related to a consumption amount of the first fixing device and third data related to a consumption amount of the third fixing device.

2. The information processing apparatus according to claim 1, wherein a fixing device of the second type comprises an envelope-dedicated fixing device.

3. The information processing apparatus according to claim 1, wherein a fixing device of the second type is adjusted differently from a fixing device of the first type in order to fix an image onto a medium of predetermined thickness.

4. An image forming apparatus to which one of fixing devices of different types is selectively attachable, the image forming apparatus comprising:

a memory configured to store data related to consumption amounts of the fixing devices;

a controller configured to:

obtain information related to a type of a fixing device that is attached to an image forming apparatus;

determine, in a case where a first fixing device of a first type is replaced with a second fixing device of a second type that is different from the first type, a remaining period until a replacement time of the second fixing device based on second data related to a consumption amount of the second fixing device; and determine, in a case where the first fixing device is replaced with a third fixing device of the first type, a remaining period until a replacement time of the third fixing device based on first data related to a consumption amount of the first fixing device and third data related to a consumption amount of the third fixing device.

5. A control method for an image forming apparatus to which one of fixing devices of different types is selectively attachable and that has a memory storing data related to consumption amounts of fixing devices of different types, the control method comprising:

obtaining information related to a type of a fixing device that is attached to an image forming apparatus;

determining, in a case where a first fixing device of a first type is replaced with a second fixing device of a second type that is different from the first type, a remaining period until a replacement time of the second fixing device based on second data related to a consumption amount of the second fixing device; and determining, in a case where the first fixing device is replaced with a third fixing device of the first type, a remaining period until a replacement time of the third fixing device based on first data related to a consumption amount of the first fixing device and third data related to a consumption amount of the third fixing device.

* * * * *